US010008177B2

(12) United States Patent
Iwami

(10) Patent No.: US 10,008,177 B2
(45) Date of Patent: Jun. 26, 2018

(54) DISPLAY DEVICE

(71) Applicant: Panasonic Liquid Crystal Display Co., Ltd., Hyogo (JP)

(72) Inventor: Takashi Iwami, Hyogo (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 332 days.

(21) Appl. No.: 15/064,602

(22) Filed: Mar. 9, 2016

(65) Prior Publication Data

US 2017/0263207 A1 Sep. 14, 2017

(51) Int. Cl.
*G09G 5/02* (2006.01)
*G09G 5/00* (2006.01)

(52) U.S. Cl.
CPC ..... *G09G 5/008* (2013.01)

(58) Field of Classification Search
CPC ..... G09G 5/008
USPC ..... 345/600
See application file for complete search history.

(56) References Cited

U.S. PATENT DOCUMENTS

2010/0217888 A1* 8/2010 Ukita ..... H04L 47/12 709/234
2010/0220781 A1* 9/2010 Ikeuchi ..... H04N 21/2365 345/545
2011/0164679 A1* 7/2011 Satou ..... H04N 19/172 375/240.03

FOREIGN PATENT DOCUMENTS

JP H10-074064 A 3/1998

* cited by examiner

*Primary Examiner* — Adam J Snyder
(74) *Attorney, Agent, or Firm* — HEA law PLLC

(57) ABSTRACT

Provided is a display device, including: a timing controller including: a frequency adjusting unit configured to adjust a frequency of externally input image data, which is input from an outside; a bit rate determining unit configured to determine a bit rate necessary to transmit the externally input image data; a plurality of output buffer units different from one another in drive performance; and a buffer switching unit configured to make a switch from one of the plurality of output buffer units to another, in which the frequency adjusting unit is configured to adjust the frequency of the externally input image data based on the determined bit rate, and the buffer switching unit is configured to make a switch from one of the plurality of output buffer units to another based on the determined bit rate.

10 Claims, 12 Drawing Sheets

FIG.3

| BIT RATE INFORMATION BI | DRIVE PERFORMANCE | SWITCHING SIGNAL |
|---|---|---|
| LOW LEVEL (X1～X2) | LOW | SW1 |
| INTERMEDIATE LEVEL (X2～X3) | INTERMEDIATE | SW2 |
| HIGH LEVEL (X3～X4) | HIGH | SW3 |

FIG.7

| BIT RATE INFORMATION BI | DRIVE VOLTAGE |
|---|---|
| LOW LEVEL (X1～X2) | LOW |
| INTERMEDIATE LEVEL (X2～X3) | INTERMEDIATE |
| HIGH LEVEL (X3～X4) | HIGH |

FIG.10

| BIT RATE INFORMATION BI | FREQUENCY DIFFUSION RANGE |
|---|---|
| LOW LEVEL (X1～X2) | WIDE |
| INTERMEDIATE LEVEL (X2～X3) | INTERMEDIATE |
| HIGH LEVEL (X3～X4) | NARROW |

DISPLAY DEVICE

BACKGROUND

1. Technical Field

This application relates to a display device.

2. Description of the Related Art

Display devices have been enhanced in definition, and the resultant rise in drive frequency has increased power consumption. A technology aimed to reduce power consumption is disclosed in, for example, Japanese Patent Application Laid-open No. Hei 10-74064. The technology disclosed in Japanese Patent Application Laid-open No. Hei 10-74064 specifically involves setting the drive frequency low when the image to be displayed is a still image.

On the other hand, display devices that employ serial data transmission are being proposed in response to the increase in the volume of image data transmission in recent years. In serial data transmission in general, transmitting the same data in succession generates radio-frequency (RF) noise having a frequency component that corresponds to the cycle of the pattern of the succession.

SUMMARY

When the technology of Japanese Patent Application Laid-open No. Hei 10-74064 is employed to reduce power consumption in a display device that uses the serial data transmission described above, setting a low drive frequency and a low serial data frequency causes fluctuations in noise generation frequency. As a result, there arises a problem of an increase in RF noise.

This application has been made in view of the problem described above, and an object of this application is therefore to provide a display device capable of reducing power consumption without increasing RF noise in data transmission.

In order to solve the above-mentioned problem, according to one embodiment of this application, there is provided a display device, including: a display panel configured to display an image; a timing controller including: a frequency adjusting unit configured to adjust a frequency of externally input image data, which is input from an outside; a bit rate determining unit configured to determine a bit rate necessary to transmit the externally input image data; a plurality of output buffer units different from one another in drive performance; and a buffer switching unit configured to make a switch from one of the plurality of output buffer units to another; and a source driver configured to output a source signal to the display panel based on corrected image data, which is output from the timing controller. In the display device, the frequency adjusting unit is configured to adjust the frequency of the externally input image data based on the determined bit rate, and the buffer switching unit is configured to make a switch from one of the plurality of output buffer units to another based on the determined bit rate.

In the display device according to the one embodiment of this application, as the determined bit rate is lower, the frequency adjusting unit may set a lower frequency to the externally input image data and the buffer switching unit may select the output buffer unit that is lower in drive performance.

In the display device according to the one embodiment of this application, when the bit rate determining unit determines that a bit rate of the externally input image data is a first bit rate, the frequency adjusting unit may set the frequency of the externally input image data to a first frequency and the buffer switching unit may select a first output buffer unit. In the display device, when the bit rate determining unit determines that the bit rate of the externally input image data is a second bit rate, which is lower than the first bit rate, the frequency adjusting unit may set the frequency of the externally input image data to a second frequency, which is lower than the first frequency, and the buffer switching unit may select a second output buffer unit, which is lower in drive performance than the first output buffer unit.

In the display device according to the one embodiment of this application, the timing controller may include a first output buffer and a second output buffer. In the display device, the plurality of output buffer units may include a first output buffer unit and a second output buffer unit, which are different from each other in drive performance. In the display device, the first output buffer unit may be comprised of the first output buffer, and the second output buffer unit may be comprised by connecting the first output buffer and the second output buffer in parallel.

In order to solve the above-mentioned problem, according to one embodiment of this application, there is provided a display device, including: a display panel configured to display an image; a timing controller including: a frequency adjusting unit configured to adjust a frequency of externally input image data, which is input from an outside; a bit rate determining unit configured to determine a bit rate necessary to transmit the externally input image data; and a drive voltage adjusting unit configured to adjust a drive voltage of the externally input image data; and a source driver configured to output a source signal to the display panel based on corrected image data, which is output from the timing controller. In the display device, the frequency adjusting unit is configured to adjust the frequency of the externally input image data based on the determined bit rate, and the drive voltage adjusting unit is configured to adjust the drive voltage of the externally input image data based on the determined bit rate.

In the display device according to the one embodiment of this application, as the determined bit rate is lower, the frequency adjusting unit may set a lower frequency to the externally input image data and the drive voltage adjusting unit may set a lower drive voltage to the externally input image data.

In the display device according to the one embodiment of this application, when the bit rate determining unit determines that a bit rate of the externally input image data is a first bit rate, the frequency adjusting unit may set the frequency of the externally input image data to a first frequency and the drive voltage adjusting unit may set the drive voltage of the externally input image data to a first drive voltage. In the display device, when the bit rate determining unit determines that the bit rate of the externally input image data is a second bit rate, which is lower than the first bit rate, the frequency adjusting unit may set the frequency of the externally input image data to a second frequency, which is lower than the first frequency, and the drive voltage adjusting unit may set the drive voltage of the externally input image data to a second drive voltage, which is lower than the first drive voltage.

In order to solve the above-mentioned problem, according to one embodiment of this application, there is provided a display device, including: a display panel configured to display an image; a timing controller including: a frequency adjusting unit configured to adjust a frequency of externally input image data, which is input from an outside; a bit rate determining unit configured to determine a bit rate necessary to transmit the externally input image data; and a frequency diffusion range adjusting unit configured to adjust a frequency diffusion range of the externally input image data; and a source driver configured to output a source signal to the display panel based on corrected image data, which is output from the timing controller. In the display device, the frequency adjusting unit is configured to adjust the frequency of the externally input image data based on the determined bit rate, and the frequency diffusion range adjusting unit is configured to adjust the frequency diffusion range of the externally input image data based on the determined bit rate.

In the display device according to the one embodiment of this application, as the determined bit rate is lower, the frequency adjusting unit may set a lower frequency to the externally input image data and the frequency diffusion range adjusting unit may set a wider frequency diffusion range to the externally input image data.

In the display device according to the one embodiment of this application, when the bit rate determining unit determines that a bit rate of the externally input image data is a first bit rate, the frequency adjusting unit may set the frequency of the externally input image data to a first frequency and the frequency diffusion range adjusting unit may set the frequency diffusion range of the externally input image data to a first frequency diffusion range. In the display device, when the bit rate determining unit determines that the bit rate of the externally input image data is a second bit rate, which is lower than the first bit rate, the frequency adjusting unit may set the frequency of the externally input image data to a second frequency, which is lower than the first frequency, and the frequency diffusion range adjusting unit may set the frequency diffusion range of the externally input image data to a second frequency diffusion range, which is wider than the first frequency diffusion range.

BRIEF DESCRIPTION OF THE DRAWINGS

FIG. 3 is a diagram for illustrating an example of an LUT in the data correction unit of FIG. 2.

FIG. 7 is a diagram for illustrating an example of an LUT in the data correction unit of FIG. 6.

FIG. 10 is a diagram for illustrating an example of an LUT in the data correction unit of FIG. 9.

DETAILED DESCRIPTION

An embodiment of this application is described below with reference to the accompanying drawings. The following description takes a liquid crystal display device as an example. However, a display device according to this application is not limited to liquid crystal display devices and can be, for example, an organic EL display device.

Figure 1:
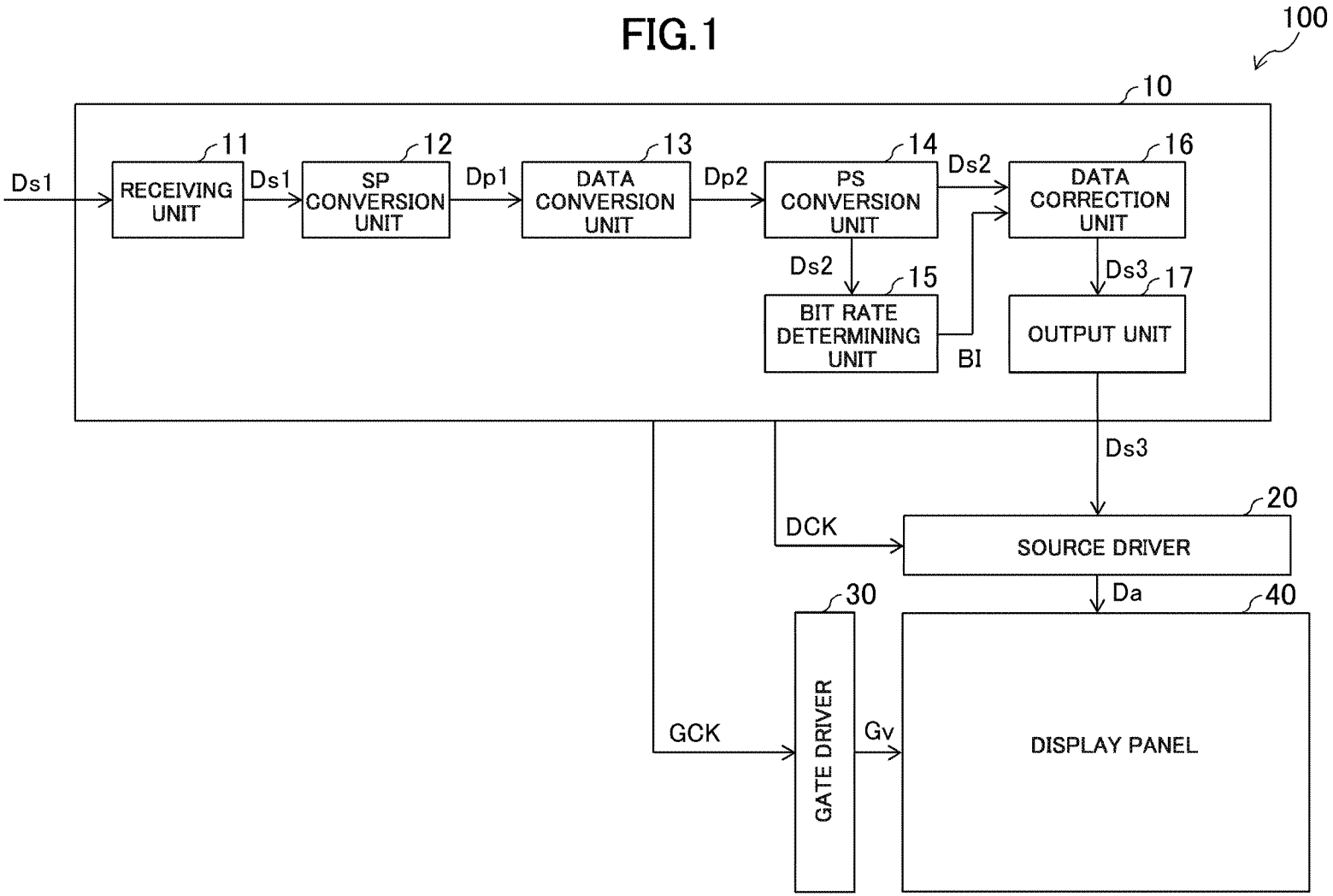
FIG. 1 is a diagram for illustrating the schematic configuration of a liquid crystal display device according to an embodiment of this application.

FIG. 1 is a diagram for illustrating the schematic configuration of a liquid crystal display device according to the embodiment of this application. The liquid crystal display device according to this embodiment transmits data by serial transmission. A liquid crystal display device 100 includes a timing controller 10, a source driver 20, a gate driver 30, and a display panel 40.

The timing controller 10 includes a receiving unit 11, a serial/parallel conversion unit 12 (SP conversion unit), a data conversion unit 13, a parallel/serial conversion unit 14 (PS conversion unit), a bit rate determining unit 15, a data correction unit 16, and an output unit 17. A system (not shown) provided outside the liquid crystal display device 100 outputs, for example, image data Ds1, which is serial data, and a timing signal (e.g., clock signal) to the timing controller 10. The receiving unit 11 of the timing controller 10 receives the image data Ds1 and the timing signal.

The serial/parallel conversion unit 12 converts the image data Ds1, which is serial data received by the receiving unit 11, into image data Dp1, which is parallel data. The image data Dp1 is input to the data conversion unit 13.

The data conversion unit 13 encodes the image data Dp1 by bit conversion. For example, the data conversion unit 13 encodes the image data Dp1 that is 8-bit data into image data Dp2 that is 9-bit data. The data conversion unit 13 in this case functions as an 8b/9b encoder. To give another example, the data conversion unit 13 encodes the image data Dp1 that is 8-bit data into the image data Dp2 that is 10-bit data. The data conversion unit 13 in this case functions as an 8b/10b encoder. The data bit conversion in the data conversion unit 13 is not limited to 8b/9b conversion and 8b/10b conversion, and a known bit conversion method can be employed. The image data Dp2 is input to the parallel/serial conversion unit 14.

The parallel/serial conversion unit 14 converts the image data Dp2, which is parallel data, into image data Ds2, which is serial data. The image data Ds2 is input to the bit rate determining unit 15 and the data correction unit 16.

The bit rate determining unit 15 determines a bit rate necessary to transmit image data Ds3, which is to be output from the timing controller 10. The bit rate determining unit 15 determines the bit rate based on parameters such as the data amount of the image data Ds2, the resolution of the image data Ds2, the resolution of the display panel 40, and the clock frequency. The bit rate determining unit 15 may determine the bit rate based on a value set by a known bit rate switching function (not shown) that the timing controller 10 has. The bit rate determining unit 15 outputs the result of the determination (bit rate information BI) to the data correction unit 16.

The data correction unit 16 receives the image data Ds2 and the bit rate information BI, and corrects the image data Ds2 based on the bit rate information BI. For example, when the bit rate is lower than a predetermined value, the data correction unit 16 executes processing of setting a low frequency to the image data Ds2 (serial data) and preventing RF noise from increasing as well (RF noise processing). The image data Ds3 created through correction by the data correction unit 16 is input to the source driver 20 via the output unit 17. Though not shown, the timing controller 10 sets the drive frequency low when the bit rate is lower than the predetermined value. The drive frequency is set low when, for example, the image data Ds1 is a low resolution image and the bit rate is lower than the predetermined value. The timing controller 10 sets the drive frequency low also when, for example, the image data Ds1 is data corresponding to a still image. This is because, with still images, motion blurring is not a concern irrespective of whether the resolution is high or low, and the vertical frequency can therefore be lowered, which consequently means a drop in bit rate. Power consumption can be reduced in this manner.

Figure 2:
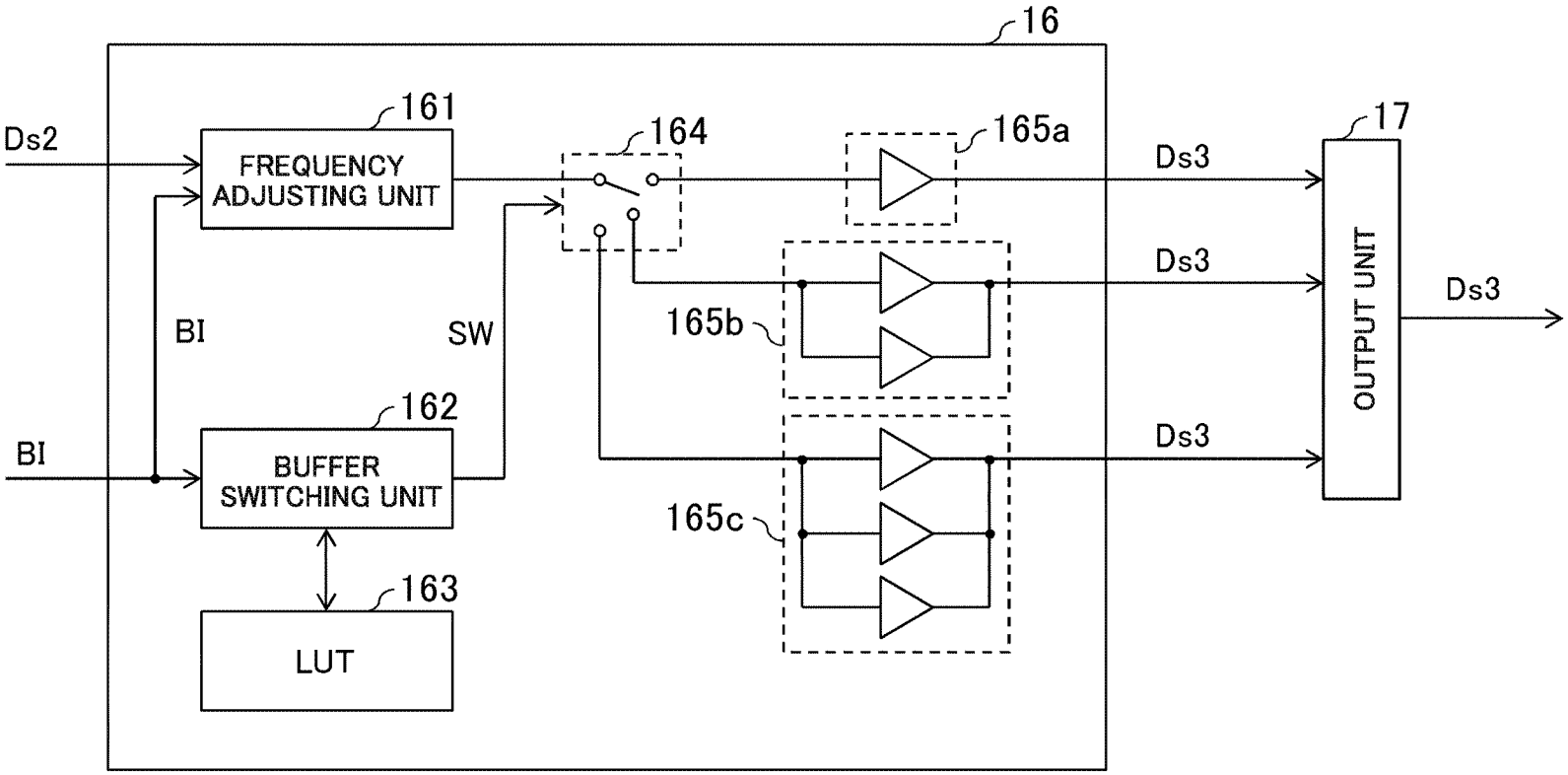
FIG. 2 is a diagram for illustrating one way to configure a data correction unit to implement first RF noise processing.

The specifics of the RF noise processing are described next. FIG. 2 is a diagram for illustrating one way to configure the data correction unit 16 to implement first RF noise processing. The data correction unit 16 illustrated in FIG. 2 includes a frequency adjusting unit 161, a buffer switching unit 162, a lookup table (LUT) 163, a selector switch 164, and a plurality of output buffer units 165 (here, 165*a*, 165*b*, and 165*c*). The number of output buffer units 165 is not limited.

The frequency adjusting unit 161 receives the image data Ds2 output from the parallel/serial conversion unit 14 and the bit rate information BI output from the bit rate determining unit 15, and adjusts the frequency of the image data Ds2 based on the bit rate information BI. For example, when the bit rate in the received bit rate information BI is at a low level (e.g., a bit rate for still images), the frequency adjusting unit 161 lowers the frequency of the image data Ds2.

The buffer switching unit 162 receives the bit rate information BI from the bit rate determining unit 15, and outputs a switching signal SW that is set in the LUT 163 in association with the bit rate information BI to the selector switch 164. The selector switch 164 receives the switching signal SW from the buffer switching unit 162, and selects one of the plurality of output buffer units 165, here, 165*a*, 165*b*, and 165*c*, based on the switching signal SW. In this manner, the image data Ds2 output from the parallel/serial conversion unit 14 is adjusted in frequency as needed and then input to the output buffer unit 165 that is selected by the selector switch 164.

The output buffer unit 165*a* is made up of one output buffer, the output buffer unit 165*b* is made up of two output buffers connected in parallel, and the output buffer unit 165*c* is made up of three output buffers connected in parallel. Each output buffer has the same size and the same drive performance. Generally speaking, the drive performance is higher and a target electric potential is reached in a shorter time when the number of output buffers is larger. The drive performance of the output buffer unit 165*b* is therefore higher than the drive performance of the output buffer unit 165*a*, and the drive performance of the output buffer unit 165*c* is higher than the drive performance of the output buffer unit 165*b*. Each output buffer unit 165 is thus set to a different level of drive performance. The output buffer units 165 are not limited to the configuration described above, and varying the drive performance from one output buffer unit 165 to another may be accomplished by, for example, varying the size of transistors from which the output buffers are comprised.

FIG. 3 is a diagram for illustrating an example of the LUT 163. The LUT 163 associates the bit rate information BI, the drive performance of the output buffer units 165, and the switching signal SW. For example, a low-level (X1 to X2) bit rate is associated with a switching signal SW1, which is for setting the drive performance to a low level. An intermediate-level (X2 to X3) bit rate is associated with a switching signal SW2, which is for setting the drive performance to an intermediate level. A high-level (X3 to X4) bit rate is associated with a switching signal SW3, which is for setting the drive performance to a high level. The selector switch 164 selects the output buffer unit 165*c* when receiving the switching signal SW3, selects the output buffer unit 165*b* when receiving the switching signal SW2, and selects the output buffer unit 165*a* when receiving the switching signal SW1.

Figure 4:
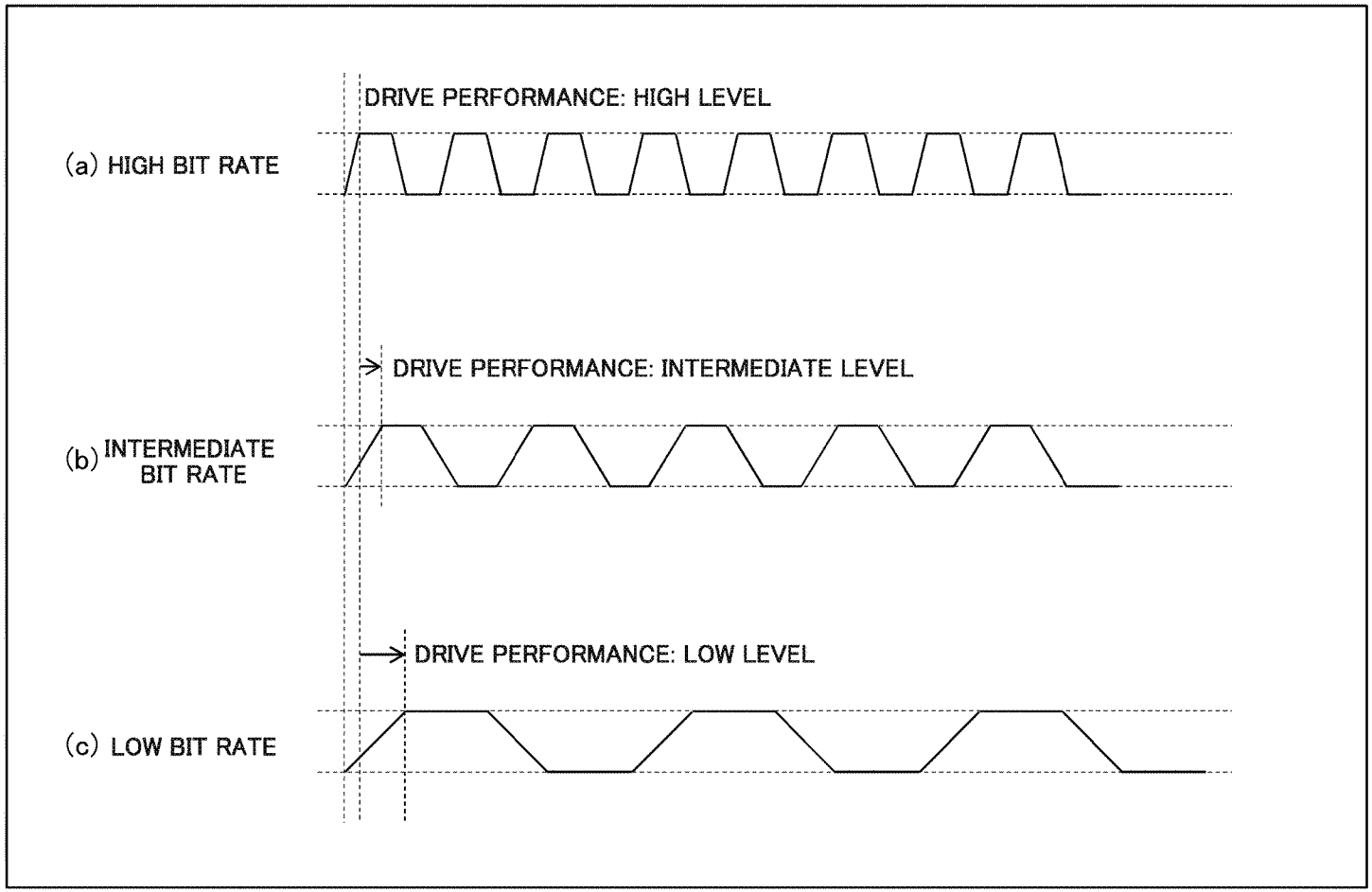
FIG. 4 is a diagram for illustrating signal waveforms of image data that has been corrected by the data correction unit of FIG. 2.

According to this configuration, the image data Ds2 is input to the output buffer unit 165*c* when the bit rate is at a high level, and the image data Ds3 corrected by the output buffer unit 165*c* is output from the timing controller 10. The signal waveform of the image data Ds3 when the bit rate is at a high level is illustrated in part (a) of FIG. 4. When the bit rate is at an intermediate level, the image data Ds2 is input to the output buffer unit 165*b*, and the image data Ds3 corrected by the output buffer unit 165*b* is output from the timing controller 10. The signal waveform of the image data Ds3 when the bit rate is at an intermediate level is illustrated in part (b) of FIG. 4. When the bit rate is at a low level, the image data Ds2 is input to the output buffer unit 165*a*, and the image data Ds3 corrected by the output buffer unit 165*a* is output from the timing controller 10. The signal waveform of the image data Ds3 when the bit rate is at a low level is illustrated in part (c) of FIG. 4. In this manner, a low frequency is set to image data (serial data) and the drive performance of the output buffer unit is set low when the transmission of the image data Ds3 requires a low bit rate. Fluctuations in noise generation frequency can thus be reduced, and power consumption can therefore be reduced without increasing RF noise in data transmission. In addition, with the configuration described above, the correction processing is executed dynamically each time the image data Ds1 is input. An example of an image that needs to be transmitted at a low-level bit rate is a still image. An example of an image that needs to be transmitted at an intermediate-level bit rate is a moving image that is low in resolution. An example of an image that needs to be transmitted at a high-level bit rate is a moving image that is high in resolution.

Figure 5:
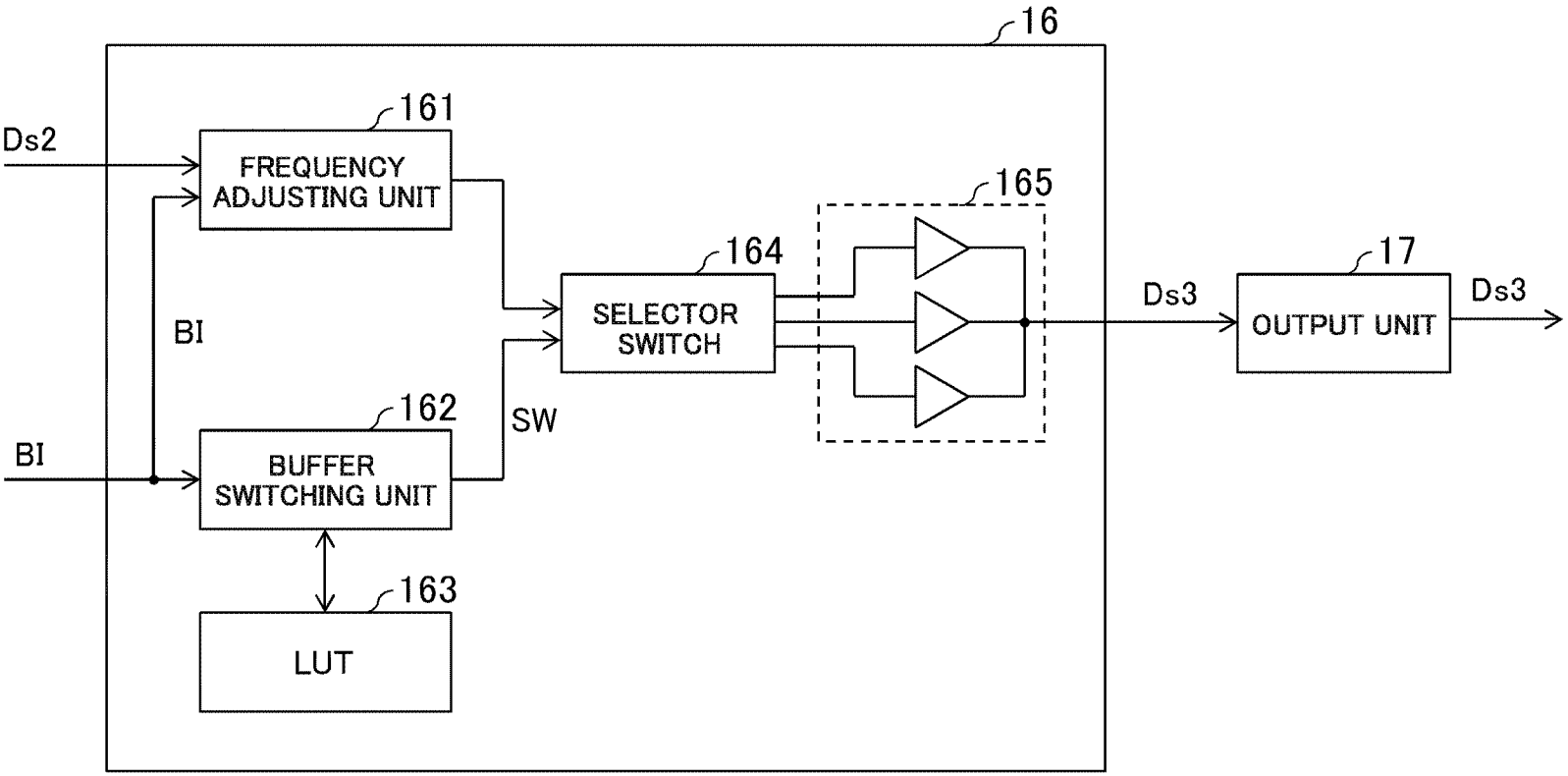
FIG. 5 is a diagram for illustrating another way to configure the data correction unit to implement the first RF noise processing.

The output buffer units 165 are not limited to the configuration described above. FIG. 5 is a diagram for illustrating another configuration in which one output buffer unit 165 is installed. The output buffer unit 165 of FIG. 5 uses three output buffers to comprise a plurality of output buffer units different from one another in drive performance. The selector switch 164 receives the switching signal SW from the buffer switching unit 162, and makes a switch from one of the plurality of output buffer units to another by switching the connection of input portions of the three output buffers based on the switching signal SW. Specifically, the selector switch 164 connects the three output buffers in parallel to comprise a first output buffer unit when the received switching signal is SW3. When the received switching signal is SW2, the selector switch 164 connects two output buffers in parallel to comprise a second output buffer unit. When the received switching signal is SW1, the selector switch 164 connects one output buffer to comprise third output buffer unit. Thus, the first output buffer unit is comprised by connecting the three output buffers in parallel, the second output buffer unit is comprised by connecting two of the three output buffers in parallel, and the third output buffer unit is comprised of one of the three output buffers. The drive performance is varied among the first output buffer unit, the second output buffer unit, and the third output buffer unit in this manner. According to this configuration, the image data Ds3 that is created by correcting the image data Ds2 with three output buffers (the first output buffer unit) is output from the timing controller 10 when the bit rate is at a high level. When the bit rate is at an intermediate level, the image data Ds3 that is created by correcting the image data Ds2 with two output buffers (the second output buffer unit) is output from the timing controller 10. When the bit rate is at a low level, the image data Ds3 that is created by correcting the image data Ds2 with a single output buffer (the third output buffer unit) is output from the timing controller 10. This way, the same effects as those of the configuration illustrated in FIG. 2 are obtained and, in addition, the circuit scale and accordingly the cost can be made smaller than in the configuration of FIG. 2.

Figure 6:
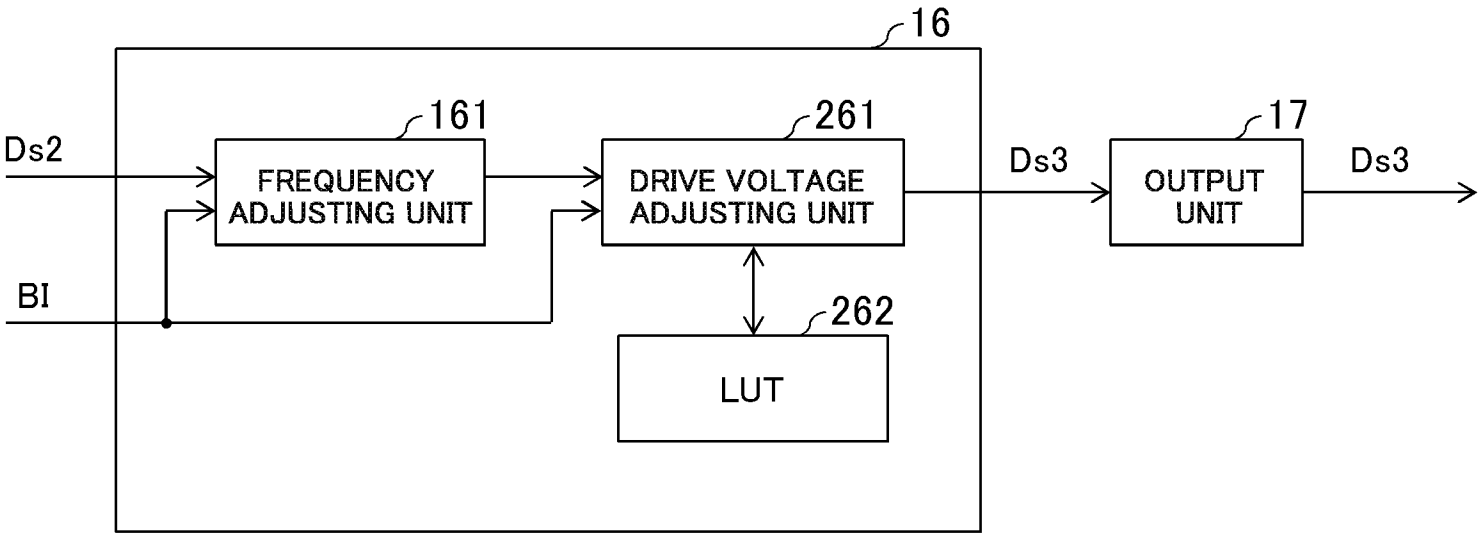
FIG. 6 is a diagram for illustrating one way to configure a data correction unit to implement second RF noise processing.

FIG. 6 is a diagram for illustrating how the data correction unit 16 is configured to implement second RF noise processing. In the data correction unit 16 of FIG. 6, components that have the same functions as those in the data correction unit 16 of FIG. 2 are denoted by the same reference symbols, and descriptions thereof are omitted. The data correction unit 16 of FIG. 6 includes the frequency adjusting unit 161, a drive voltage adjusting unit 261, and an LUT 262.

The drive voltage adjusting unit 261 receives the image data Ds2 adjusted in frequency by the frequency adjusting unit 161 and the bit rate information BI output from the bit rate determining unit 15, and adjusts the drive voltage of the image data Ds2 to a drive voltage that is set in the LUT 262 in association with the bit rate information BI.

FIG. 7 is a diagram for illustrating an example of the LUT 262. The LUT 262 associates the bit rate information BI and the drive voltage of the image data Ds2. For example, a low-level (X1 to X2) bit rate is associated with a drive voltage of low level. An intermediate-level (X2 to X3) bit rate is associated with a drive voltage of intermediate level. A high-level (X3 to X4) bit rate is associated with a drive voltage of high level.

Figure 8:
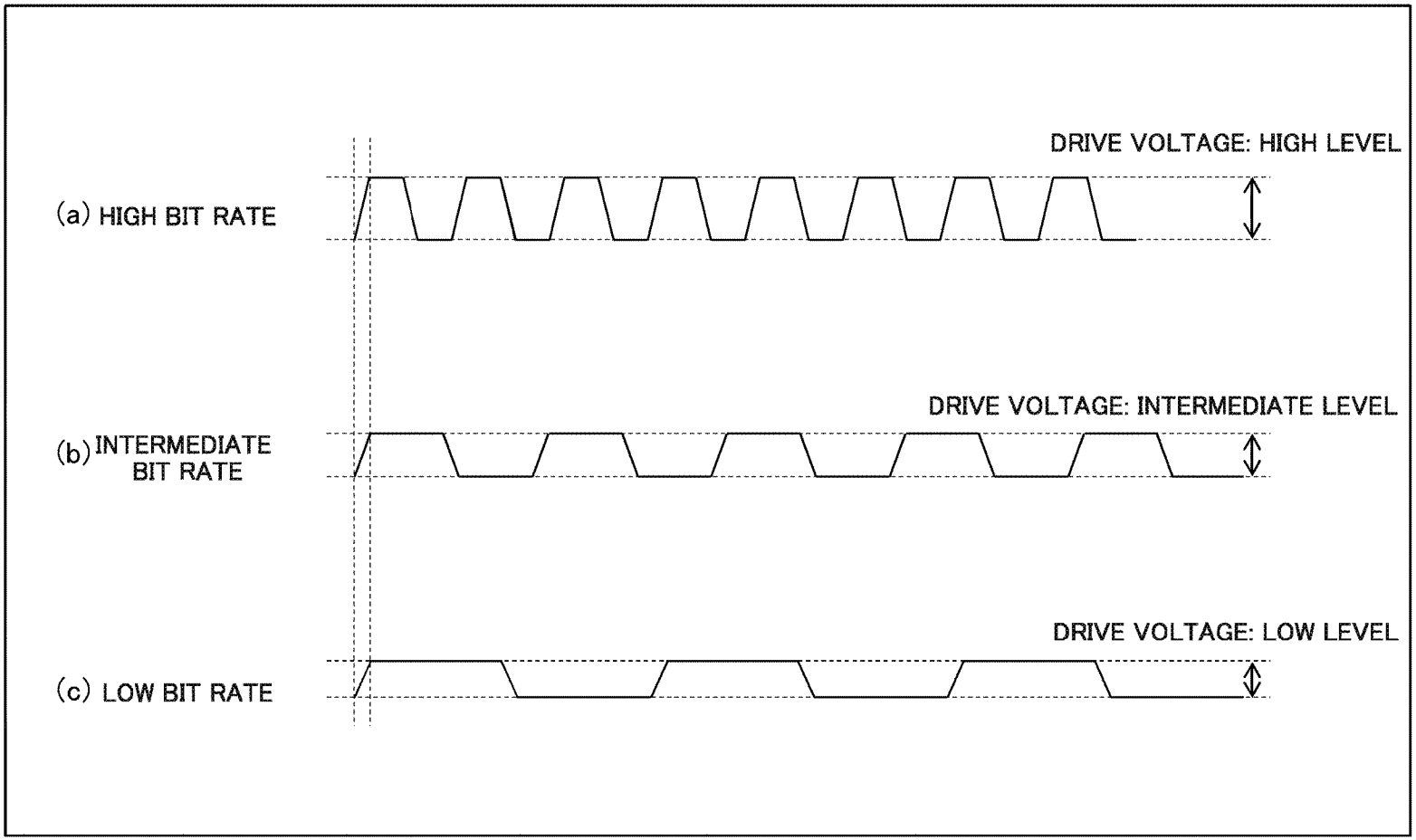
FIG. 8 is a diagram for illustrating signal waveforms of image data that has been corrected by the data correction unit of FIG. 6.

According to this configuration, the image data Ds3 that has a high-level drive voltage is output from the timing controller 10 when the bit rate is at a high level. The signal waveform of the image data Ds3 when the bit rate is at a high level is illustrated in part (a) of FIG. 8. When the bit rate is at an intermediate level, the image data Ds3 that has an intermediate-level drive voltage is output from the timing controller 10. The signal waveform of the image data Ds3 when the bit rate is at an intermediate level is illustrated in part (b) of FIG. 8. When the bit rate is at a low level, the image data Ds3 that has a low-level drive voltage is output from the timing controller 10. The signal waveform of the image data Ds3 when the bit rate is at a low level is illustrated in part (c) of FIG. 8. In this manner, a low frequency is set to image data (serial data) and the drive voltage of the image data is set low when the transmission of the image data Ds3 requires a low bit rate. Fluctuations in noise generation frequency can thus be reduced, and power consumption can therefore be reduced without increasing RF noise in data transmission. In addition, with the configuration described above, the correction processing is executed dynamically each time the image data Ds1 is input.

Figure 9:
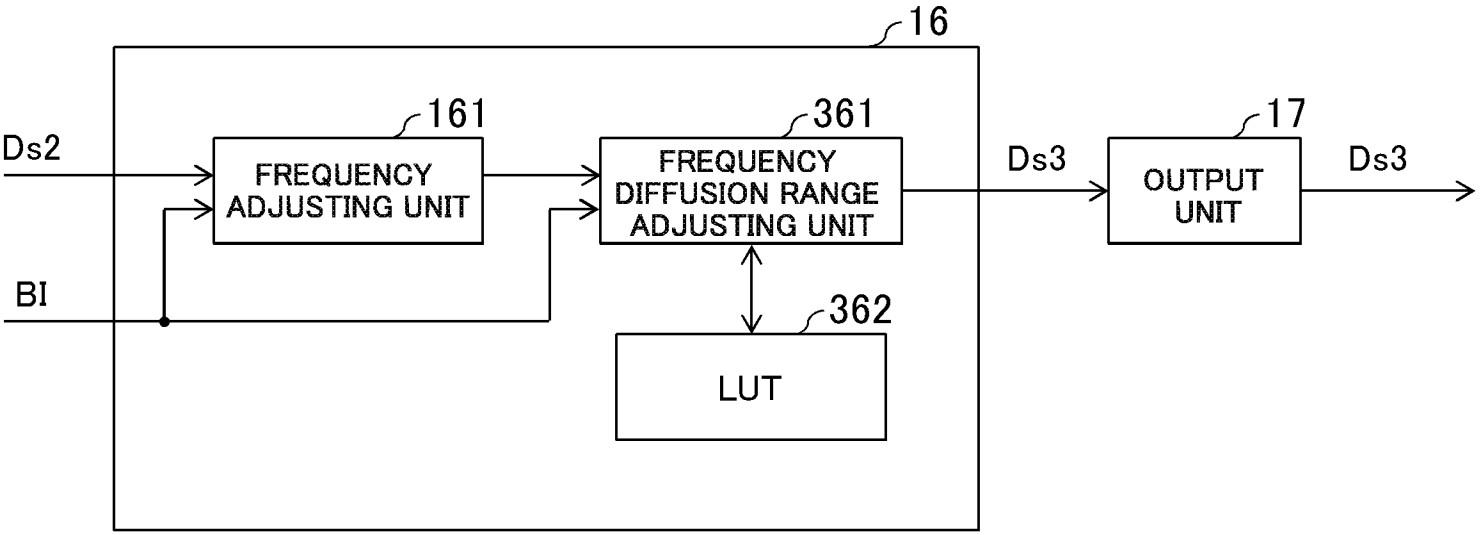
FIG. 9 is a diagram for illustrating one way to configure a data correction unit to implement third RF noise processing.

FIG. 9 is a diagram for illustrating how the data correction unit 16 is configured to implement third RF noise processing. In the data correction unit 16 of FIG. 9, components that have the same functions as those in the data correction unit 16 of FIG. 2 are denoted by the same reference symbols, and descriptions thereof are omitted. The data correction unit 16 of FIG. 9 includes the frequency adjusting unit 161, a frequency diffusion range adjusting unit 361, and an LUT 362.

The frequency diffusion range adjusting unit 361 receives the image data Ds2 adjusted in frequency by the frequency adjusting unit 161 and the bit rate information BI output from the bit rate determining unit 15, and adjusts a frequency diffusion range of the image data Ds2 to a frequency diffusion range that is set in the LUT 362 in association with the bit rate information BI. In general, in the frequency diffusion, the RF noise reduction effect is greater as the diffusion range is wider (as the diffusion amount is larger).

FIG. 10 is a diagram for illustrating an example of the LUT 362. The LUT 362 associates the bit rate information BI and the frequency diffusion range of the image data Ds2. For example, a low-level (X1 to X2) bit rate is associated with a wide diffusion range. An intermediate-level (X2 to X3) bit rate is associated with a diffusion range of intermediate level. A high-level (X3 to X4) bit rate is associated with a narrow diffusion range.

Figure 11:
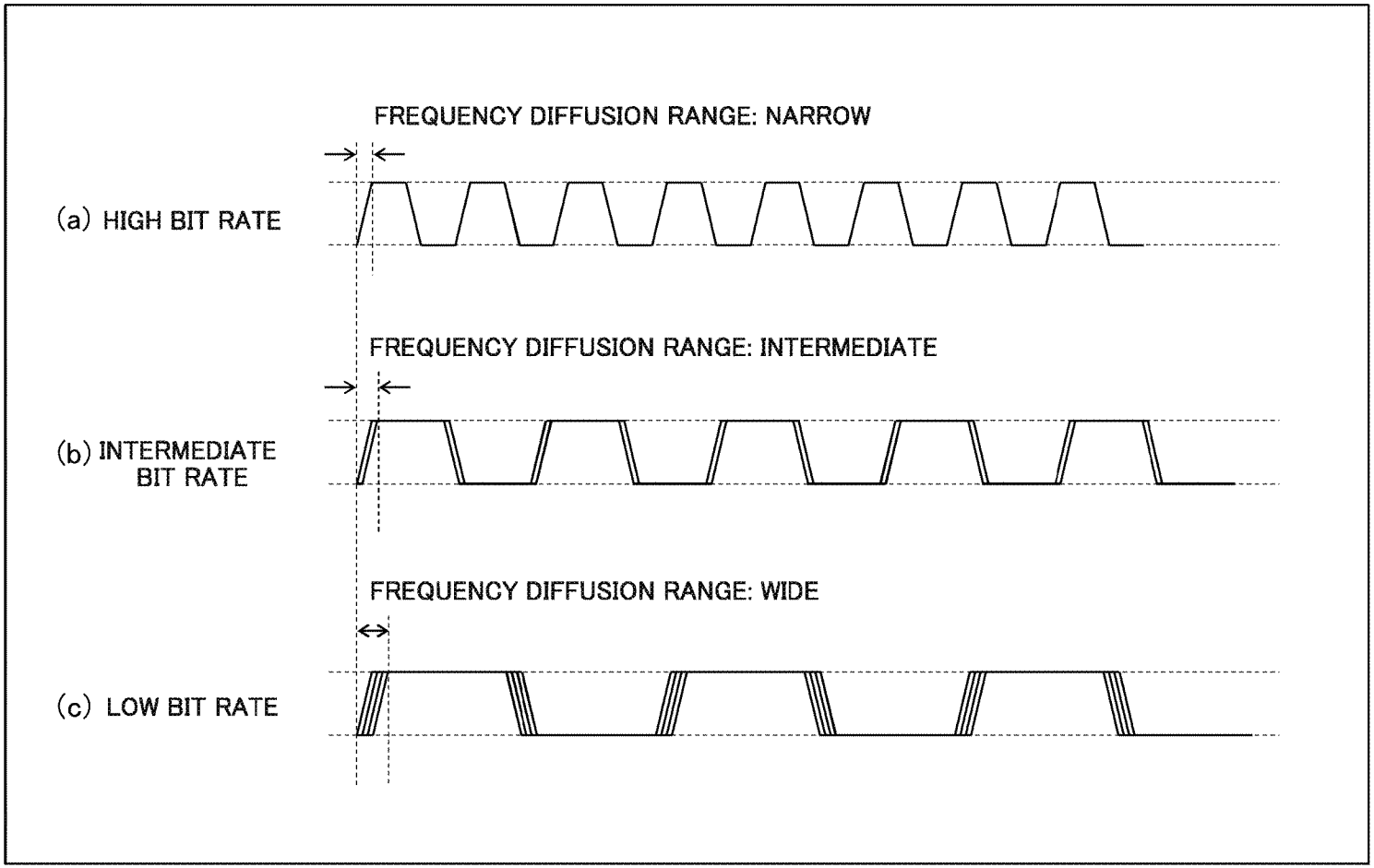
FIG. 11 is a diagram for illustrating signal waveforms of image data that has been corrected by the data correction unit of FIG. 9.

According to this configuration, the image data Ds3 that has a narrow frequency diffusion range is output from the timing controller 10 when the bit rate is at a high level. The signal waveform of the image data Ds3 when the bit rate is at a high level is illustrated in part (a) of FIG. 11. When the bit rate is at an intermediate level, the image data Ds3 that has an intermediate-level frequency diffusion range is output from the timing controller 10. The signal waveform of the image data Ds3 when the bit rate is at an intermediate level is illustrated in part (b) of FIG. 11. When the bit rate is at a low level, the image data Ds3 that has a wide frequency diffusion range is output from the timing controller 10. The signal waveform of the image data Ds3 when the bit rate is at a low level is illustrated in part (c) of FIG. 11. In this manner, a low frequency is set to image data (serial data) and the frequency diffusion range of the image data is set wide when the transmission of the image data Ds3 requires a low bit rate. Fluctuations in noise generation frequency can thus be reduced, and power consumption can therefore be reduced without increasing RF noise in data transmission. In addition, with the configuration described above, the correction processing is executed dynamically each time the image data Ds1 is input.

The data correction unit 16 of the timing controller 10 executes at least one of the first RF noise processing, the second RF noise processing, or the third RF noise processing. In other words, the data correction unit 16 may execute processing of correcting image data by combining the first RF noise processing, the second RF noise processing, and the third RF noise processing. The data correction unit 16 may determine what combination of the first RF noise processing, the second RF noise processing, and the third RF noise processing to use based on image information that includes the resolution and eye pattern of image data and on the bit rate information BI.

The bit rate ranges set in the LUTs 163, 262, and 362 are not limited to three levels, and may be two levels or four or more levels. Similarly, the drive performance levels (FIG. 3), drive voltage levels (FIG. 7), and frequency diffusion ranges (FIG. 10) set in the LUTs 163, 262, and 362 are not limited to three levels, and may be two levels or four or more levels.

Figure 12:
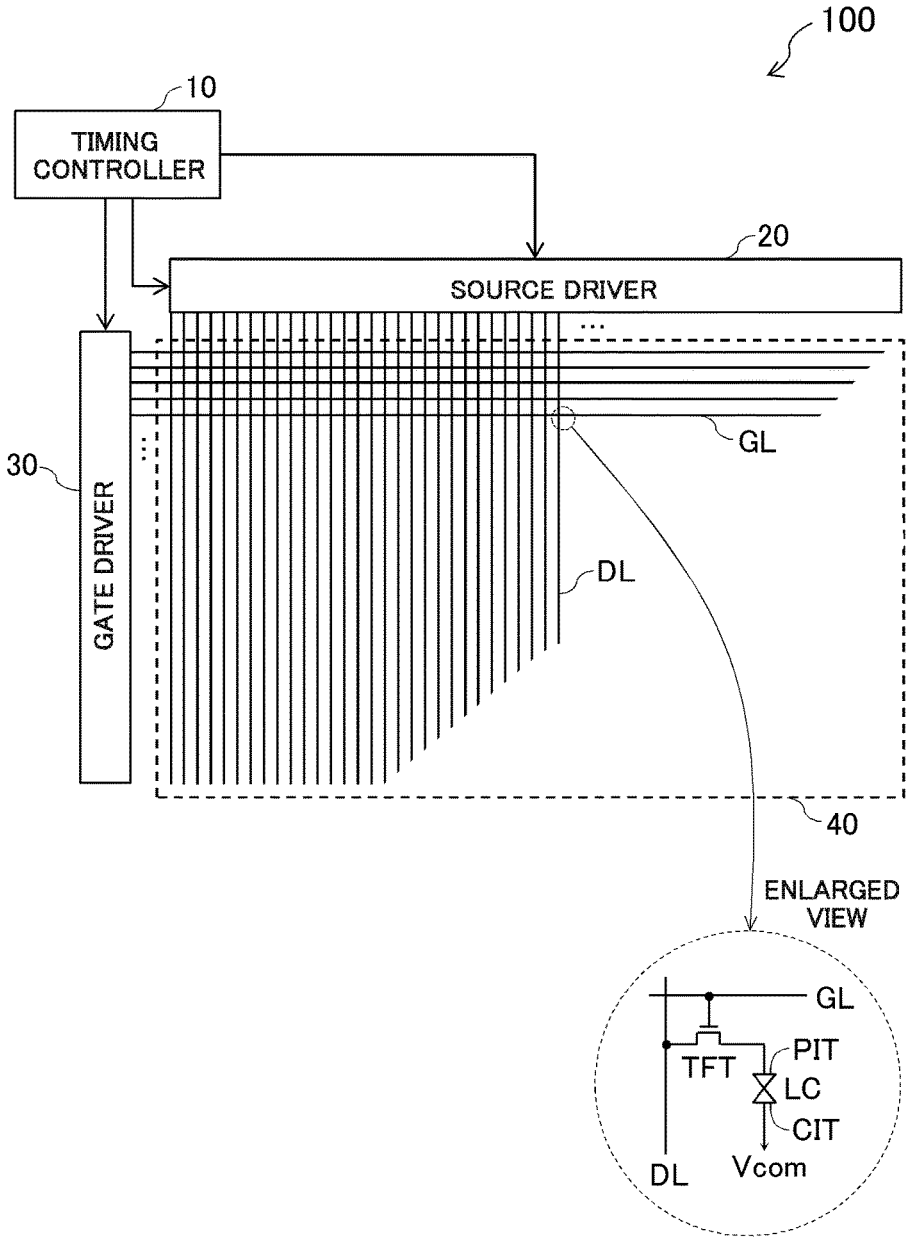
FIG. 12 is a diagram for illustrating the schematic configuration of a display panel according to an embodiment of this application.

A known configuration can be employed for the display panel 40 illustrated in FIG. 1. The configuration of the display panel 40 is described taking as an example a configuration that is illustrated in FIG. 12. FIG. 12 is a plan view for illustrating a specific configuration of the display panel 40.

The display panel 40 includes a thin film transistor (TFT) substrate (not shown), a color filter (CF) substrate (not shown), and a liquid crystal layer LC sandwiched between the substrates. The TFT substrate is provided with a plurality of data lines DL connected to the source driver 20 and a plurality of gate lines GL connected to the gate driver 30. A thin film transistor TFT is provided at each intersection between one data line DL and one gate line GL. The intersections correspond to a plurality of pixels arranged on the display panel 40 in a matrix pattern (in a row direction and a column direction). The display panel 40 further includes a pixel electrode PIT and a common electrode CIT for each pixel. The display panel 40 displays an image on a display screen by turning some thin film transistors TFT on with gate signals Gv (see FIG. 1), which are supplied to the gate lines GL, based on gray scale voltages Da (source signals) (see FIG. 1), which are applied to the pixel electrodes PIT via the data lines DL. The source driver 20 and the gate driver 30 may be formed on the TFT substrate. The display panel 40 is not limited to the configuration described above, and can employ any known configuration.

While there have been described what are at present considered to be certain embodiments of the application, it will be understood that various modifications may be made thereto, and it is intended that the appended claims cover all such modifications as fall within the true spirit and scope of the invention.

What is claimed is:

1. A display device, comprising:

a display panel configured to display an image;

a timing controller comprising:

a frequency adjusting unit configured to adjust a frequency of externally input image data, which is input from an outside;

a bit rate determining unit configured to determine a bit rate necessary to transmit the externally input image data;

a plurality of output buffer units different from one another in drive performance; and a buffer switching unit configured to make a switch from one of the plurality of output buffer units to another; and a source driver configured to output a source signal to the display panel based on corrected image data, which is output from the timing controller, wherein the frequency adjusting unit is configured to adjust the frequency of the externally input image data based on the determined bit rate, and the buffer switching unit is configured to make a switch from one of the plurality of output buffer units to another based on the determined bit rate.

2. The display device according to claim 1, wherein, as the determined bit rate is lower, the frequency adjusting unit sets a lower frequency to the externally input image data and the buffer switching unit selects the output buffer unit that is lower in drive performance.

3. The display device according to claim 1, wherein, when the bit rate determining unit determines that a bit rate of the externally input image data is a first bit rate, the frequency adjusting unit sets the frequency of the externally input image data to a first frequency and the buffer switching unit selects a first output buffer unit, and wherein, when the bit rate determining unit determines that the bit rate of the externally input image data is a second bit rate, which is lower than the first bit rate, the frequency adjusting unit sets the frequency of the externally input image data to a second frequency, which is lower than the first frequency, and the buffer switching unit selects a second output buffer unit, which is lower in drive performance than the first output buffer unit.

4. The display device according to claim 1, wherein the timing controller comprises a first output buffer and a second output buffer, wherein the plurality of output buffer units comprise a first output buffer unit and a second output buffer unit, which are different from each other in drive performance, and wherein the first output buffer unit is comprised of the first output buffer, and the second output buffer unit is comprised by connecting the first output buffer and the second output buffer in parallel.

5. A display device, comprising:

a display panel configured to display an image;

a timing controller comprising:

a frequency adjusting unit configured to adjust a frequency of externally input image data, which is input from an outside;

a bit rate determining unit configured to determine a bit rate necessary to transmit the externally input image data; and a drive voltage adjusting unit configured to adjust a drive voltage of the externally input image data; and a source driver configured to output a source signal to the display panel based on corrected image data, which is output from the timing controller, wherein the frequency adjusting unit is configured to adjust the frequency of the externally input image data based on the determined bit rate, and the drive voltage adjusting unit is configured to adjust the drive voltage of the externally input image data based on the determined bit rate.

6. The display device according to claim 5, wherein, as the determined bit rate is lower, the frequency adjusting unit sets a lower frequency to the externally input image data and the drive voltage adjusting unit sets a lower drive voltage to the externally input image data.

7. The display device according to claim 5, wherein, when the bit rate determining unit determines that a bit rate of the externally input image data is a first bit rate, the frequency adjusting unit sets the frequency of the externally input image data to a first frequency and the drive voltage adjusting unit sets the drive voltage of the externally input image data to a first drive voltage, and wherein, when the bit rate determining unit determines that the bit rate of the externally input image data is a second bit rate, which is lower than the first bit rate, the frequency adjusting unit sets the frequency of the externally input image data to a second frequency, which is lower than the first frequency, and the drive voltage adjusting unit sets the drive voltage of the externally input image data to a second drive voltage, which is lower than the first drive voltage.

8. A display device, comprising:

a display panel configured to display an image;

a timing controller comprising:

a frequency adjusting unit configured to adjust a frequency of externally input image data, which is input from an outside;

a bit rate determining unit configured to determine a bit rate necessary to transmit the externally input image data; and a frequency diffusion range adjusting unit configured to adjust a frequency diffusion range of the externally input image data; and a source driver configured to output a source signal to the display panel based on corrected image data, which is output from the timing controller, wherein the frequency adjusting unit is configured to adjust the frequency of the externally input image data based on the determined bit rate, and the frequency diffusion range adjusting unit is configured to adjust the frequency diffusion range of the externally input image data based on the determined bit rate.

9. The display device according to claim 8, wherein, as the determined bit rate is lower, the frequency adjusting unit sets a lower frequency to the externally input image data and the frequency diffusion range adjusting unit sets a wider frequency diffusion range to the externally input image data.

10. The display device according to claim 8, wherein, when the bit rate determining unit determines that a bit rate of the externally input image data is a first bit rate, the frequency adjusting unit sets the frequency of the externally input image data to a first frequency and the frequency diffusion range adjusting unit sets the frequency diffusion range of the externally input image data to a first frequency diffusion range, and wherein, when the bit rate determining unit determines that the bit rate of the externally input image data is a second bit rate, which is lower than the first bit rate, the frequency adjusting unit sets the frequency of the externally input image data to a second frequency, which is lower than the first frequency, and the frequency diffusion range adjusting unit sets the frequency diffusion range of the externally input image data to a second frequency diffusion range, which is wider than the first frequency diffusion range.

* * * * *